US009664411B2

(12) United States Patent
Shaffer

(10) Patent No.: US 9,664,411 B2
(45) Date of Patent: May 30, 2017

(54) WATER HEATER APPLIANCE WITH AN ANGLED ANODE

(71) Applicant: General Electric Company, Schenectady, NY (US)

(72) Inventor: Timothy Scott Shaffer, La Grange, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 322 days.

(21) Appl. No.: 14/468,438

(22) Filed: Aug. 26, 2014

(65) Prior Publication Data

US 2016/0061488 A1 Mar. 3, 2016

(51) Int. Cl.

| | |
|---|---|
| ***F24H 1/00*** | (2006.01) |
| ***F24H 4/04*** | (2006.01) |
| ***H05B 3/78*** | (2006.01) |

(52) U.S. Cl.

CPC ..... *F24H 1/0018* (2013.01); *F24H 4/04* (2013.01); *H05B 3/78* (2013.01)

(58) Field of Classification Search

None

See application file for complete search history.

(56) References Cited

U.S. PATENT DOCUMENTS 1,692,646 A * 11/1928 Gannon ..... F24H 9/2021 219/510
2,041,071 A * 5/1936 Keegan ..... F24H 9/1818 392/449
RE22,866 E * 4/1947 Babson et al. ..... F24H 1/202 219/510
2,459,123 A * 1/1949 Bates ..... C23F 13/02 122/13.01
2,467,492 A * 4/1949 Oison ..... H05B 3/00 165/61
2,486,871 A * 11/1949 Osterheld ..... C23F 13/02 204/196.11
2,531,385 A * 11/1950 Barnebey ..... H05B 3/82 219/521
2,544,458 A * 3/1951 Higgins ..... H05B 3/06 392/455
2,568,594 A * 9/1951 Robinson ..... C23F 13/02 204/196.11
2,649,532 A * 8/1953 Woodman ..... F24C 7/082 204/196.16
2,656,314 A * 10/1953 Osterheld ..... C23F 13/02 122/13.01
2,852,462 A * 9/1958 Andrus ..... C03C 3/089 122/13.01
3,176,115 A * 3/1965 Balis ..... F24H 1/202 204/196.16
3,569,668 A * 3/1971 Carlisle ..... F24H 1/202 122/233
3,616,421 A * 10/1971 Mackintosh ..... C23F 13/02 204/196.16

(Continued)

*Primary Examiner* — Thor Campbell
(74) *Attorney, Agent, or Firm* — Dority & Manning, P.A.

(57) ABSTRACT

A water heater appliance includes a tank with a sidewall. A boss is mounted to the sidewall of the tank, and an anode is mounted to the boss. The anode extends through the tank into an interior volume of the tank at an angle such that the anode avoids internal tank components of the water heater appliance. A related heat pump water heater appliance is also provided.

17 Claims, 5 Drawing Sheets

(56) References Cited

U.S. PATENT DOCUMENTS 3,867,274 A * 2/1975 Herman ..... C23F 13/02 174/74 R
3,992,607 A * 11/1976 Jolin ..... F24D 11/00 137/266
4,035,903 A * 7/1977 Taggart ..... C23F 13/02 204/196.15
4,403,137 A * 9/1983 Glazer ..... F24H 1/202 392/448
4,419,567 A * 12/1983 Murphy ..... H05B 3/82 219/523
4,436,604 A * 3/1984 Walters ..... C02F 1/4602 204/196.32
4,543,469 A * 9/1985 Cunningham ..... H05B 3/04 219/523
4,773,977 A * 9/1988 Houle ..... C23F 13/02 204/196.17
4,786,383 A * 11/1988 Houle ..... C23F 13/20 204/196.11
5,158,200 A * 10/1992 Vago ..... F16L 41/10 220/289
5,176,807 A * 1/1993 Kumar ..... C23F 13/16 204/196.06
5,187,772 A * 2/1993 Rumbley ..... F24H 1/202 122/305
5,305,419 A * 4/1994 Cameron ..... F24H 9/0047 219/548
5,357,906 A * 10/1994 Brazier ..... F24D 3/082 122/15.1
5,371,831 A * 12/1994 Gauer ..... H05B 3/04 220/319
5,655,299 A * 8/1997 Lindahl ..... F16L 41/10 220/4.12
5,697,515 A * 12/1997 Syler ..... B29C 65/00 220/289
5,844,211 A * 12/1998 Henry ..... F24H 1/202 219/386
5,878,192 A * 3/1999 Jackson ..... F24H 1/202 126/344
5,906,109 A * 5/1999 Dieckmann ..... F24H 4/04 237/2 B
5,946,927 A * 9/1999 Dieckmann ..... F24H 4/04 237/2 B
6,282,372 B1 * 8/2001 Boros ..... F24H 1/202 392/449
6,370,328 B1 * 4/2002 Mottershead ..... F24H 1/202 126/639
6,606,452 B1 * 8/2003 Caine ..... F24H 9/0047 392/441
6,655,375 B2 * 12/2003 Terraneo ..... F24J 2/32 126/635
7,527,714 B2 5/2009 Kahite et al.
8,380,055 B1 * 2/2013 Bridegum ..... C23F 13/18 204/196.3
8,422,870 B2 * 4/2013 Nelson ..... F24H 4/04 392/441
2008/0190919 A1 * 8/2008 Kahite ..... C23F 13/18 220/4.12
2011/0283993 A1 * 11/2011 Winegar ..... F24D 11/003 126/585

* cited by examiner

WATER HEATER APPLIANCE WITH AN ANGLED ANODE

FIELD OF THE INVENTION

The present subject matter related generally to water heater appliances, such as heat pump water heater appliances.

BACKGROUND OF THE INVENTION

Certain water heater appliances include a tank for receiving water. Heating elements, such as electric resistance heating elements, gas burners or heat pump systems, heat water within the tank in order to generate heated water. The tank is generally formed of or with a metal, such as carbon steel. Carbon steel tanks are prone to galvanic corrosion when anodic and cathodic cells of the water heater appliance are electrically linked by an electrolyte, such as water within the tank. Inner walls of the carbon steel tanks may be coated with a porcelain enamel corrosion barrier. However, the tank may include areas where the corrosion barrier cannot be applied. Such areas are commonly referred to as "holiday regions." Corrosion of the tank at the holiday regions can be rapid and adversely affect the life of the water heater appliance.

To limit such corrosion, certain water heater appliances include an anode rod that exchanges electrons with the tank. In particular, electrons from the anode rod may flow through the electrolyte to the holiday region. Thus, the anode rod may corrode and/or lose mass over time in lieu of the carbon steel tank. The anode rod is generally located in close proximity to any holiday regions within the tank in order to facilitate corrosion protection with the anode rod. Thus, the anode rods are commonly installed such that the anode rods extends from a top of the tank downwardly towards a bottom of the tank in order to be positioned proximate holiday regions at the top and bottom of the tank. In such a manner, corrosion of the tank may be limited or prevented by providing the anode rod.

Over time, the anode rod is depleted. When depleted, the anode rod is preferably replaced in order to protect the tank. However, accessing and removing the anode rod can be difficult. For example, a tip of the anode rod is commonly encased in insulation that must be removed to access the anode rod. Removing such insulation can be inconvenient and tedious. Further, in heat pump water heater appliances, components of a sealed system may be located near the anode rod. Avoiding such components during removal of the anode rod can be difficult.

The anode rod may be threaded to the tank in order to ensure a leak tight joint and electrical continuity between the anode rod and tank. Thus, to remove the anode rod, the anode rod is rotated relative to the tank. However, rotating the anode rod relative to the tank can be difficult. For example, calcium carbonate and other hard water components solidify upon the holiday regions and other exposed surfaces of the tank, including the threaded region around the anode rod and tank interface, during operation of the water heater appliance. Such scale buildup can increase the torque required to remove the anode rod. Thus, the threads of the anode rod may bind or stick such that rotating the anode rod relative to the tank is difficult. If the threads of the anode rod stick, a repair technician attempting to break the thread lock between the tank and the anode rod may rotate the entire water heater appliance rather than just the anode rod. Such motion of the water heater appliance can damage inlet and outlet piping coupled to the water heater appliance. To avoid such motion of the water heater appliance, the repair technician may require elaborate means to resist the rotation of the water heater appliance during removal of the anode rod.

Accordingly, a water heater appliance with features for facilitating access to an anode rod of the water heater appliance would be useful. In addition, a water heater appliance with features for facilitating removal of an anode rod from the water heater appliance would be useful.

BRIEF DESCRIPTION OF THE INVENTION

The present subject matter provides a water heater appliance. The water heater appliance includes a tank with a sidewall. A boss is mounted to the sidewall of the tank, and an anode is mounted to the boss. The anode extends through the tank into an interior volume of the tank at an angle such that the anode avoids internal tank components of the water heater appliance. A related heat pump water heater appliance is also provided. Additional aspects and advantages of the invention will be set forth in part in the following description, or may be apparent from the description, or may be learned through practice of the invention.

In a first exemplary embodiment, a water heater appliance is provided. The water heater appliance defines a vertical direction. The water heater appliance includes a tank having a sidewall. The tank defines an interior volume for receiving water for heating. A boss is mounted to the sidewall of the tank. An anode is mounted to the boss. The anode extends through the tank into the interior volume of the tank such that the anode is angled relative to the sidewall of the tank.

In a second exemplary embodiment, a heat pump water heater appliance is provided. The heat pump water heater appliance defines a vertical direction. The heat pump water heater appliance includes a tank having a sidewall. The tank defines an interior volume. A sealed system is configured for heating water within the interior volume of the tank. The sealed system includes a condenser positioned on an outer surface of the tank. A boss is mounted to the sidewall of the tank. An anode is mounted to the boss. The anode extends through the tank into the interior volume of the tank such that the anode is not perpendicular to the sidewall of the tank.

In a third exemplary embodiment, a water heater appliance is provided. The water heater appliance includes a tank with a sidewall. The tank defines an interior volume for receiving water for heating. A boss is welded to the sidewall of the tank. The boss has a threaded portion. The threaded portion of the boss extends away from the sidewall of the tank along a direction that is not normal to an outer surface of the sidewall.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
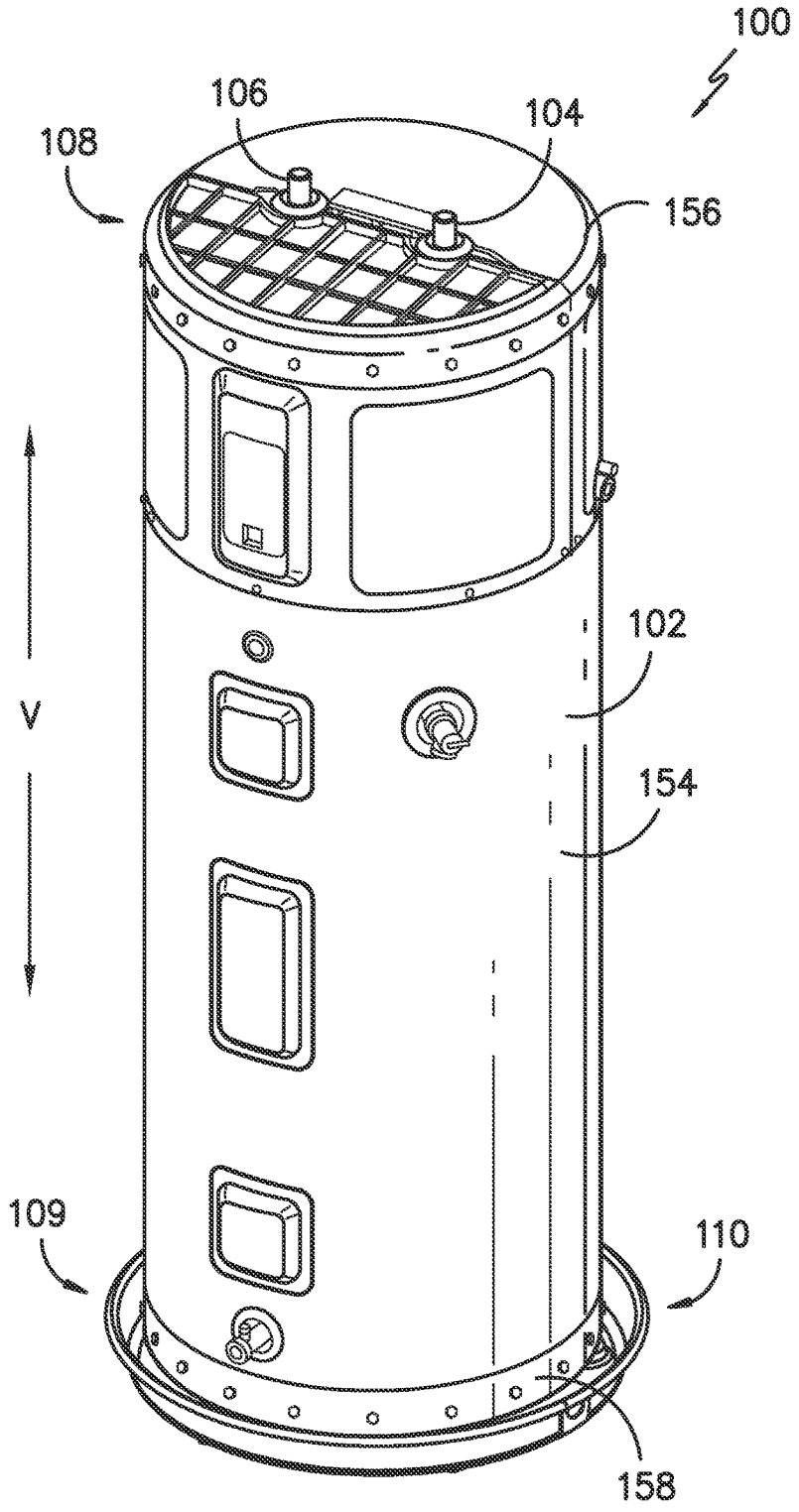
FIG. 1 provides a perspective view of a water heater appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a water heater appliance 100 according to an exemplary embodiment of the present subject matter. Water heater appliance 100 includes an outer shell or casing 102. Casing 102 generally surrounds a tank 112 (FIG. 2) such that tank 112 is disposed within casing 102. Casing 102 may be formed from a variety of components. As illustrated, casing 102 may include a wrapper 154, one or more covers, such as a top cover 156 and a bottom cover 158, and a shroud 159 as illustrated. Covers 156, 158 may be fastened or coupled to wrapper 154 and shroud 159 to form casing 102.

Upper and lower heating elements 118, 119 (FIG. 2) and a sealed system 120 (FIG. 2) may also be positioned within casing 102 for heating water within tank 112. Upper and lower heating elements 118, 119 can be any suitable heating elements. For example, upper heating element 118 and/or lower heating element 119 may be an electric resistance element, a microwave element, an induction element, or any other suitable heating element or combination thereof. Lower heating element 119 may also be a gas burner. As will be understood by those skilled in the art and as used herein, the term "water" includes purified water and solutions or mixtures containing water and, e.g., elements (such as calcium, chlorine, and fluorine), salts, bacteria, nitrates, organics, and other chemical compounds or substances.

Water heater appliance 100 also includes an inlet or cold water conduit 104 and an outlet or hot water conduit 106 that are both in fluid communication with a chamber or interior volume 114 (FIG. 2) defined by tank 112. As an example, cold water from a water source, e.g., a municipal water supply or a well, can enter water heater appliance 100 through cold water conduit 104. From cold water conduit 104, such cold water can enter interior volume 114 of tank 112 wherein it is heated with heating elements 118, 119 and/or sealed system 120 to generate heated water. Such heated water can exit water heater appliance 100 at hot water conduit 106 and, e.g., be supplied to a bath, shower, sink, or any other suitable feature.

Water heater appliance 100 extends longitudinally between a top portion 108 and a bottom portion 109 along a vertical direction V. Thus, water heater appliance 100 is generally vertically oriented. Water heater appliance 100 can be leveled, e.g., such that casing 102 is plumb in the vertical direction V, in order to facilitate proper operation of water heater appliance 100. A drain pan 110 is positioned at bottom portion 109 of water heater appliance 100 such that water heater appliance 100 sits on drain pan 110. Drain pan 110 sits beneath water heater appliance 100 along the vertical direction V, e.g., to collect water that leaks from water heater appliance 100 or water that condenses on an evaporator (not shown) of water heater appliance 100. It should be understood that water heater appliance 100 is provided by way of example only and that the present subject matter may be used with any suitable water heater appliance, including for example a heat pump water heater appliance.

Figure 2:
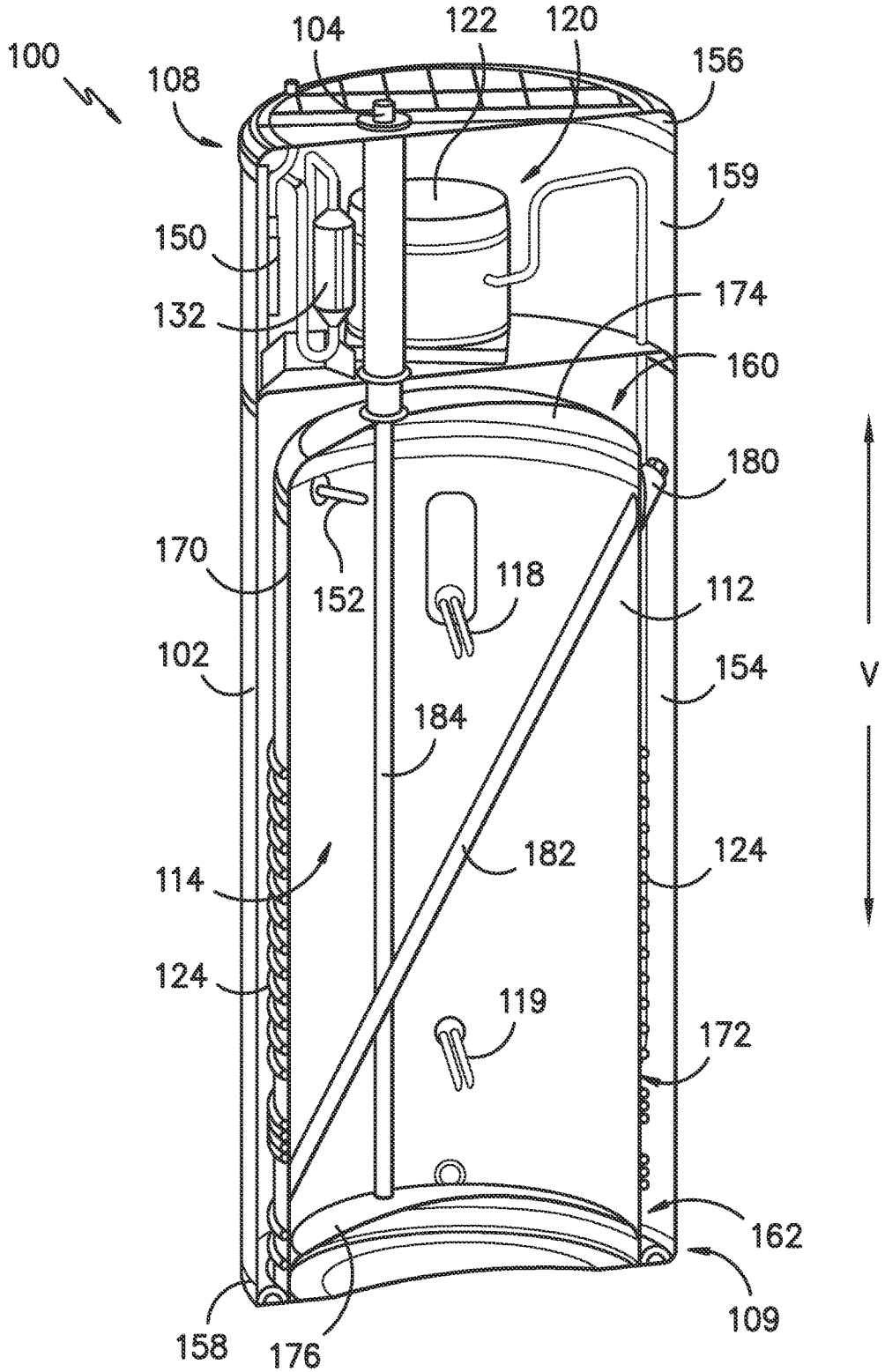
FIG. 2 provides a section view of the exemplary water heater appliance of FIG. 1.

FIG. 2 provides a section view of water heater appliance 100. As may be seen in FIG. 2, water heater appliance 100 includes sealed system 120 for heating water within interior volume 114 of tank 112. Sealed system 120 generally operates in a heat pump cycle. Thus, water heater appliance 100 is commonly referred to as a "heat pump water heater appliance." Water heater appliance 100 may additionally include one or more auxiliary heating elements, such as upper heating element 118 and/or lower heating element 119.

Sealed system 120 may include a compressor 122, a condenser 124 and an evaporator (not shown). Compressor 122 and/or evaporator of sealed system 120 may be disposed within casing 102 at top portion 108 of water heater appliance 100, e.g., within shroud 159. As is generally understood, various conduits may be utilized to flow refrigerant between the various components of sealed system 120. Thus, e.g., evaporator may be between and in fluid communication with condenser 124 and compressor 122. During operation of sealed system 120, refrigerant may flow from the evaporator through compressor 122. For example, refrigerant may exit the evaporator as a fluid in the form of a superheated vapor and/or high quality vapor mixture. Upon exiting the evaporator, the refrigerant may enter compressor 122. Compressor 122 may be operable to compress the refrigerant. Accordingly, the pressure and temperature of the refrigerant may be increased in compressor 122 such that the refrigerant becomes a superheated vapor.

Condenser 124 may be assembled in a heat exchange relationship with tank 112 in order to heat water within interior volume 114 of tank 112 during operation of sealed system 120. In particular, condenser 124 may be positioned downstream of and in fluid communication with compressor 122, and may be operable to heat the water within interior volume 114 using energy from the refrigerant. For example, the superheated vapor from compressor 122 may enter condenser 124 wherein it transfers energy to the water within tank 112 and condenses into a saturated liquid and/or liquid vapor mixture.

Sealed system 120 may also include a throttling device 132 between condenser 124 and the evaporator. Refrigerant, which may be in the form of high quality/saturated liquid vapor mixture, may exit condenser 124 and travel through throttling device 132 before flowing through the evaporator. Throttling device 132 may generally expand the refrigerant, lowering the pressure and temperature thereof. The refrigerant may then be flowed through evaporator.

Throttling device 132 may be any suitable components for generally expanding the refrigerant. For example, in some exemplary embodiments, throttling device 132 may be a Joule-Thomson expansion valve, also known as a "J-T valve." In other exemplary embodiments, throttling device 132 may be an ejector. In still other exemplary embodiments, a capillary tube, fixed orifice, or other suitable apparatus may be utilized as throttling device 132.

Water heater appliance 100 may additionally include a temperature sensor 152. Temperature sensor 152 may be configured for measuring a temperature of water within interior volume 114 of tank 112. Temperature sensor 152 can be positioned at any suitable location within water heater appliance 100. For example, temperature sensor 152 may be positioned within interior volume 114 of tank 112 or may be mounted to tank 112 outside of interior volume 114 of tank 112. Temperature sensor 152 may further be positioned within upper portion 160 or lower portion 162. When mounted to tank 112 outside of interior volume 114 of tank 112, temperature sensor 152 can be configured for indirectly measuring the temperature of water within interior volume 114 of tank 112. For example, temperature sensor 152 can measure the temperature of tank 112 and correlate the temperature of tank 112 to the temperature of water within interior volume 114 of tank 112. Temperature sensor 152 may be any suitable temperature sensor. For example, temperature sensor 152 may be a thermocouple or a thermistor.

Water heater appliance 100 may further include a controller 150 (FIG. 1) that regulates operation of water heater appliance 100. Controller 150 may be, for example, in operative communication with sealed system 120 (such as compressor 122, and/or other components thereof), auxiliary heating elements, and/or temperature sensor 152. Thus, controller 150 can selectively activate system 120 and/or auxiliary heating elements in order to heat water within interior volume 114 of tank 112.

Controller 150 includes memory and one or more processing devices such as microprocessors, CPUs or the like, such as general or special purpose microprocessors operable to execute programming instructions or micro-control code associated with operation of water heater appliance 100. The memory can represent random access memory such as DRAM, or read only memory such as ROM or FLASH. The processor executes programming instructions stored in the memory. The memory can be a separate component from the processor or can be included onboard within the processor. Alternatively, controller 150 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Figure 3:
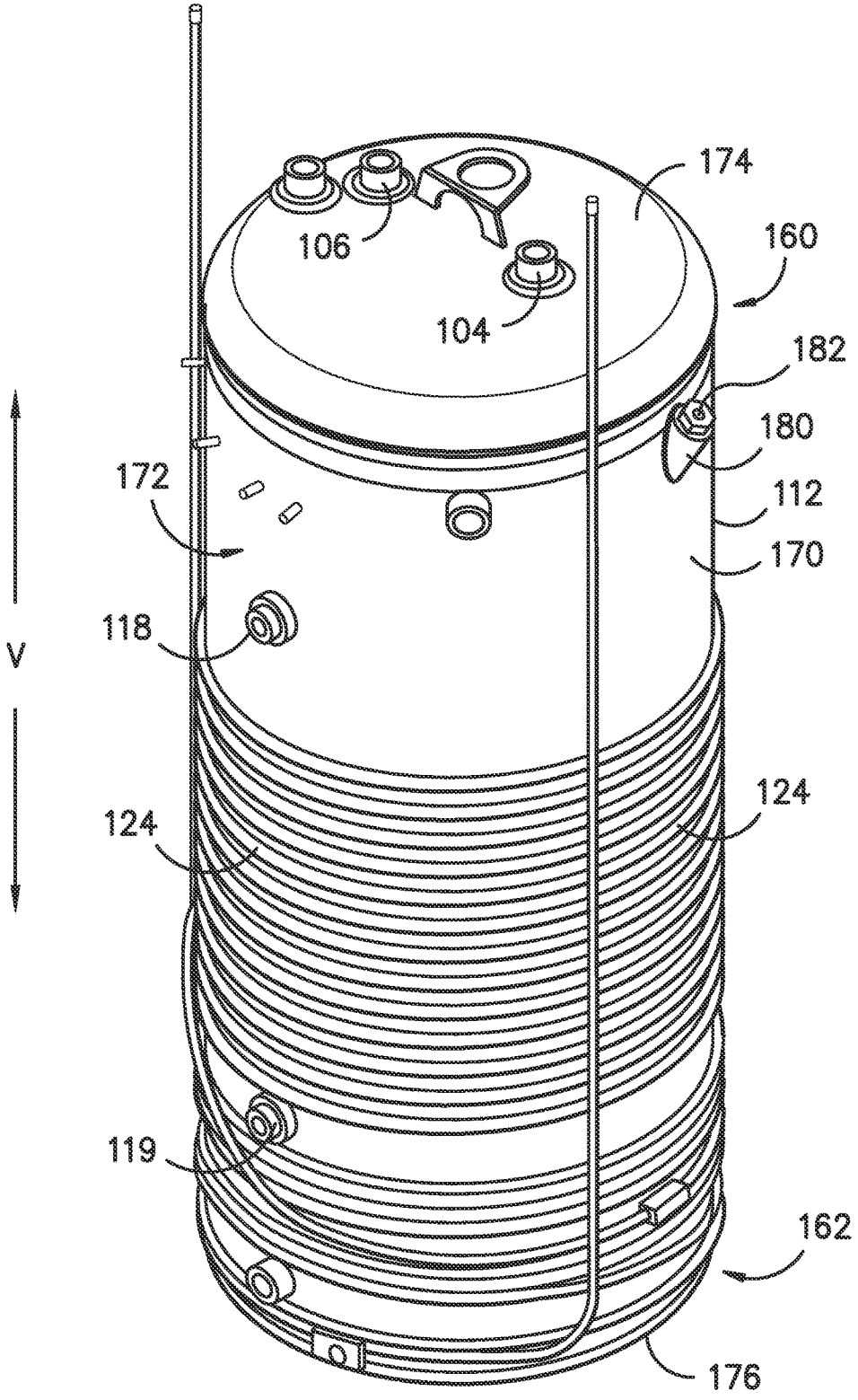
FIG. 3 provides a perspective view of a tank and a condenser of the exemplary water heater appliance of FIG. 1.
Figure 4:
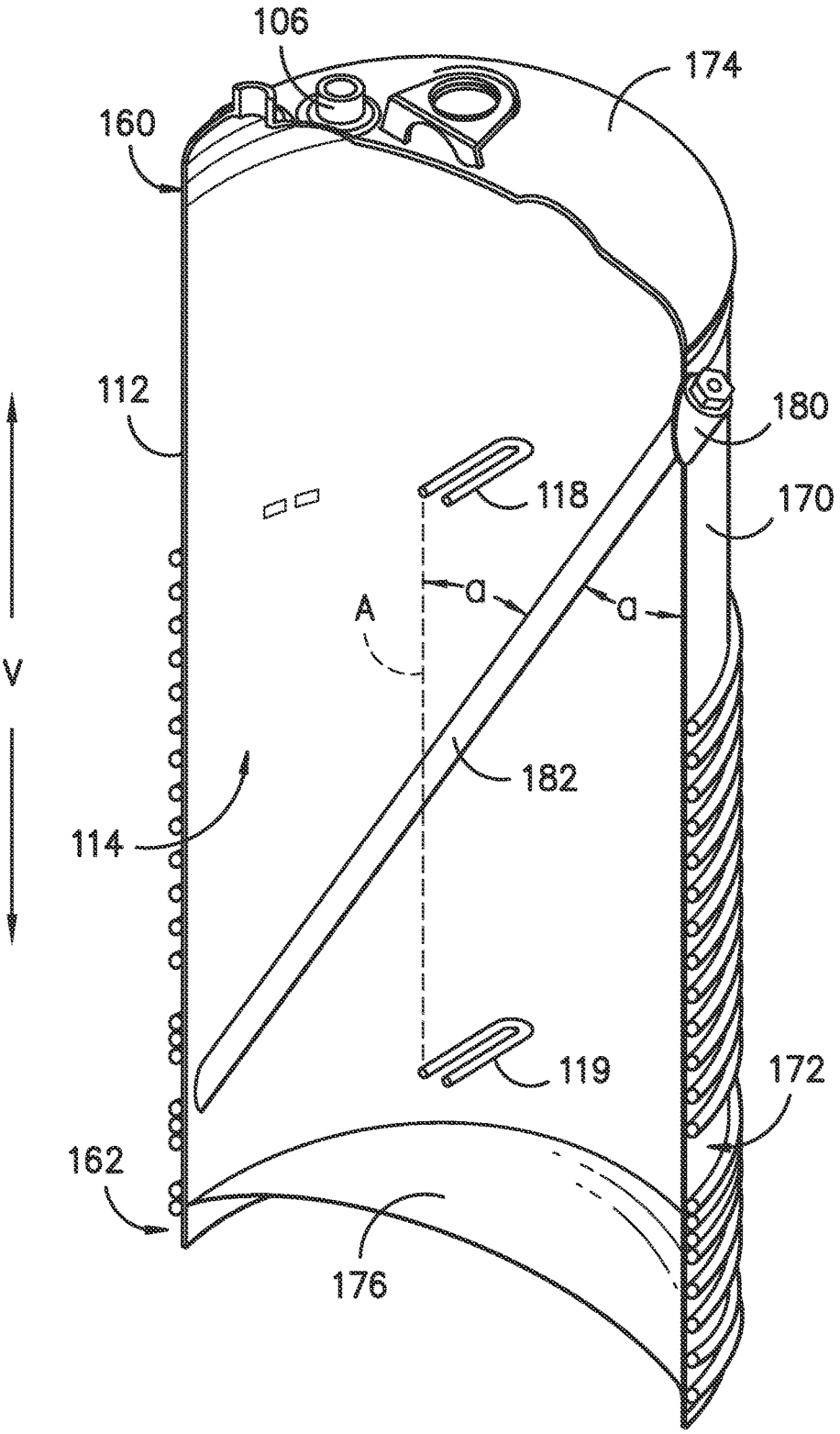
FIG. 4 provides a section view of the tank and condenser of FIG. 3.

FIG. 3 provides a perspective view of tank 112 and condenser 124 of water heater appliance 100. FIG. 4 provides a section view of tank 112 and condenser 124. As may be seen in FIGS. 3 and 4, tank 112 includes a sidewall 170, a top wall 174 and a bottom wall 176. Top wall 174 is mounted to sidewall 170, e.g., at upper portion 160 of tank 112. Bottom wall 176 is mounted to sidewall 170, e.g., at lower portion 162 of tank 112. Thus, top and bottom walls 174, 176 are spaced apart from each other, e.g., along the vertical direction V, and sidewall 170 extends between and connects top and bottom walls 174, 176. Sidewall 170, top wall 174 and bottom wall 176 cooperate to define interior volume 114 of tank 112.

Water heater appliance 100 also includes a boss 180 and an anode rod or anode 182. Boss 180 is mounted to tank 112, and anode 182 is mounted to boss 180. Anode 182 extends from boss 180 through tank 112 into interior volume 114 of tank 112. Within interior volume 114 of tank 112, anode 182 assists with limiting or preventing corrosion of tank 112. In particular, water within interior volume 114 of tank 112 may react with and corrode anode 182 rather than tank 112. In such a manner, anode 182 may assist with increasing a durability or performance of tank 112 and/or water heater appliance 100. Anode 182 may be constructed of or with any suitable material. For example, anode 182 may be constructed of or with a magnesium alloy, an aluminum alloy, combinations thereof, etc.

Boss 180 may be positioned at any suitable location on tank 112. For example, boss 180 may be mounted to sidewall 170 of tank 112. In particular, boss 180 may be positioned on an outer surface 172 of sidewall 170 proximate top portion 160 of tank 112. As shown in FIGS. 3 and 4, condenser 124 may also be positioned on or coiled about outer surface 172 of sidewall 170. In particular, condenser 124 may also be positioned on or coiled about outer surface 172 of sidewall 170 at lower portion 162 of tank 112. Thus, boss 180 may be positioned above windings of condenser 124, e.g., along the vertical direction V, on outer surface 172 of sidewall 170, as shown in FIGS. 3 and 4.

Anode 182 is mounted to boss 180. In particular, anode 182 may be mounted to boss 180 at outer surface 172 of sidewall 170 such that anode 182 is removable from boss 180 and sidewall 170. Thus, a user of water appliance 100 may remove or detach anode 182 from boss 180, e.g., in order to remove or replace anode 182 when anode 182 is depleted. Anode 182 may be mounted to boss 180 using any suitable method or mechanism. For example, anode 182 may be threaded, welded, adhered or fastened to boss 180.

As discussed above, anode 182 extends through tank 112, e.g., sidewall 170, into interior volume 114 of tank 112. In addition, a dip tube 184 is mounted to tank 112 at upper portion 160 of tank 112. For example, dip tube 184 may be mounted to top wall 174 of tank 112. Dip tube 184 extends downwardly along the vertical direction V, e.g., from top wall 174, into interior volume 114 of tank 112. Dip tube 184 is coupled to cold water conduit 104 and is configured for directing water into interior volume 114 of tank 112, e.g., at lower portion 162 of tank 112.

As may be seen in FIG. 2, dip tube 184 and anode 182 are positioned and oriented such that dip tube 184 and anode 182 do not extend parallel to each other within interior volume 114 of tank 112. Turning back to FIG. 4, tank 112 defines a longitudinal axis A, e.g., between upper and lower portions 160, 162 of tank 112. The longitudinal axis A may be parallel to the vertical direction V. Anode 182 extends into interior volume 114 of tank 112 such that anode 182 define an angle, $\alpha$, with the longitudinal axis A. The angle $\alpha$ may be any suitable angle. For example, the angle $\alpha$ may be greater than fifteen degrees and less than forty-five degrees. As another example, the angle $\alpha$ is about (e.g., within five degrees of) thirty degrees. Thus, anode 182 and dip tube 184 are angled relative to each other within interior volume 114 of tank 112. Anode 182 may also be angled in a similar manner to sidewall 170 of tank 112 and/or the vertical direction V. Anode 182 may have any suitable length. For example, a length of anode 182 may be at least thirty-eight inches.

By mounting boss 180 to sidewall 170 and angling anode 182 within interior volume 114 of tank 112, anode 182 may be accessed and/or replaced efficiently and/or easily. For example, placing boss 180 on sidewall 170 of tank 112 rather than top wall 174 of tank 112 may permit a service technician or user of water heater appliance 100 to access anode 182 without having to remove significant amounts of foam insulation or remove components of sealed system 120. In addition, such placement of anode 182 and boss 180 may assist with limiting or decreasing the risk of damage to components of sealed system 120 within shroud 159 during removal of anode 182. Further, the service technician or user of water heater appliance 100 may have to rotate anode 182 relative to boss 180 in order to unthread anode 182 from boss 180. Placing boss 180 on sidewall 170 rather than top wall 174 may assist with hindering or limiting rotation of tank 112 when the service technician or user of water heater appliance 100 is attempting to rotate anode 182 relative to boss 180 in order to unthread anode 182 from boss 180. In such a manner, placement of boss 180 and anode 182 on sidewall 170 of tank 112 may assist a service technician or user of water heater appliance 100 with accessing and/or servicing anode 182.

Figure 5:
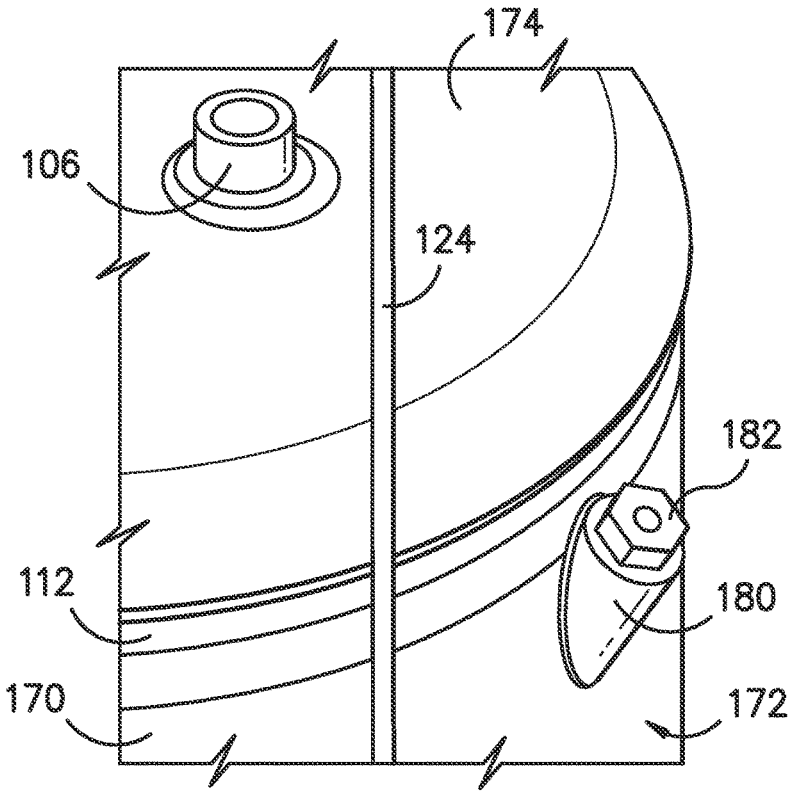
FIG. 5 provides a partial, perspective view of an anode rod and a boss of the exemplary water heater appliance of FIG. 1.
Figure 6:
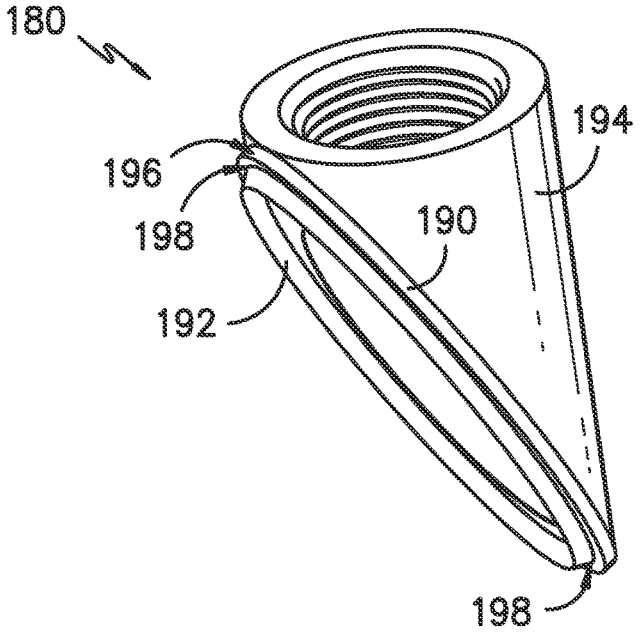
FIG. 6 provides a perspective view of the boss of FIG. 5.

FIG. 5 provides a partial, perspective view of anode rod 182 and boss 180 of water heater appliance 100. FIG. 6 provides a perspective view of boss 180. As may be seen in FIG. 6, boss 180 includes a face plate 190 and a lip 192. Referring now to FIGS. 3 and 6, face plate 190 may be positioned on sidewall 170 of tank 112. Lip 192 extends from face plate 190 towards or into sidewall 170, e.g., such that lip 170 extends through sidewall 170 of tank 112 into interior volume 114 of tank 112. Boss 180 may be welded to sidewall 170 of tank 112 at a perimeter or junction 198 between face plate 190 and lip 192, e.g., where lip 192 meets face plate 190. The junction 198 between face plate 190 and lip 192 may elliptical, in certain exemplary embodiments.

Boss 180 also includes a treaded cylindrical portion 194. Treads on anode 182 may engage threaded cylindrical portion 194 in order to mount anode 182 to boss 180. A top edge 196 of face plate 190 is positioned at or above a thread of threaded cylindrical portion 194 when boss 180 is mounted to sidewall 170. Such positioning of top edge 196 of face plate 190 may permit a weld torch to access and be positioned at junction 198, e.g., at forty-five degrees or more, in order to weld boss 180 to sidewall 170 at the top edge 196 of face plate 190.

An exemplary method for forming tank 112 is discussed in greater detail below with reference to FIGS. 3 and 4. Sidewall 170 of tank 112 may be formed from a flat panel or sheet of metal, such as carbon steel. As a first step, holes for various features of tank 112, including boss 180, may be cut into the sheet of metal. After forming the holes, the sheet of metal may be rolled into a cylindrical shape and welded at a seam to form sidewall 170 of tank 112. Top wall 174 may also be formed from a flat sheet of metal, such as carbon steel. The flat sheet of metal may be cut to form holes and may also be pressed to form the concave shape of top wall 174. After shaping the sheet of metal, top wall 174 may be welded to sidewall 170. Threaded bosses, including boss 180, may then be inserted into holes of sidewall 170 and top wall 174, and the bosses may be welded to sidewall 170 and top wall 174. As an example, two bosses (one for cold water conduit 104 and one for hot water conduit 106) are welded to top wall 174, and five bosses (one for a tank drain, one for a safety valve, one for upper heating element 118, one for lower heating element 119, and boss 180 for anode 182) are welded to sidewall 170. After welding the bosses to tank 112, tank 112 is enameled with a porcelain enamel. After enameling, bottom wall 176 is formed and mounted to sidewall 170. Bottom wall 176 may be formed from a flat sheet of metal, such as carbon steel. The flat sheet of metal may be pressed to form the concave shape of bottom wall 176 and also enameled. After shaping and enameling the sheet of metal, bottom wall 176 may be welded to sidewall 170. In such a manner, sidewall 170, top wall 174 and bottom wall 176 of tank 112 may be formed and mounted to each other to form tank 112.

It should be understood that boss 180 may be used to mount any other suitable component of water heater appliance 100 to tank 112, in alternative exemplary embodiments. For example, boss 180 may be used to mount upper heating element 118, lower heating element 119 or dip tube 184 to tank 184. Thus, boss 180 may be used to mount any suitable component of water heater appliance 100 to tank 112 such that the component is angled relative to sidewall 170 of tank 112, e.g., and not perpendicular to sidewall 170 of tank 112, within interior volume 114 of tank 112.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A water heater appliance defining a vertical direction, the water heater appliance comprising:

a tank having a top wall, a bottom wall, and a vertical sidewall extending between the top wall and the bottom wall, the tank defining an interior volume for receiving water for heating;

a boss including a threaded cylindrical portion, a face plate, a lip, and an elliptical junction between the face plate and the lip, the elliptical junction of the boss welded to the vertical sidewall of the tank; and an anode threaded to the threaded cylindrical portion of the boss, the anode extending through the tank into the interior volume of the tank such that the anode is angled relative to the vertical sidewall of the tank.

2. The water heater appliance of claim 1, wherein the vertical sidewall of the tank extends between a top portion and a bottom portion of the tank along the vertical direction, the boss positioned proximate the top portion of the tank.

3. The water heater appliance of claim 2, wherein the top wall is mounted to the vertical sidewall at the top portion of the tank and the bottom wall is mounted to the vertical sidewall at the bottom portion of the tank.

4. The water heater appliance of claim 1, further comprising a dip tube mounted to the tank at a top portion of the tank, the dip tube extending downwardly along the vertical direction into the interior volume of the tank, the dip tube configured for directing water into the interior volume of the tank, the dip tube and the anode positioned and oriented such that the dip tube and the anode do not extend parallel to each other.

5. The water heater appliance of claim 1, wherein the tank defines a longitudinal axis, the anode defining an angle, $\alpha$, with the longitudinal axis, the angle $\alpha$ being greater than fifteen degrees and less than forty-five degrees.

6. The water heater appliance of claim 5, wherein the angle $\alpha$ is about thirty degrees.

7. The water heater appliance of claim 1, wherein the face plate is positioned on the vertical sidewall of the tank, the lip extending from the face plate towards the vertical sidewall of the tank.

8. The water heater appliance of claim 7, wherein a top edge of the face plate is positioned at or above a thread of the threaded cylindrical portion.

9. A heat pump water heater appliance defining a vertical direction, the heat pump water heater appliance comprising:

a tank having a top wall, a bottom wall, and a vertical sidewall extending between the top wall and the bottom wall, the tank defining an interior volume;

a sealed system configured for heating water within the interior volume of the tank, the sealed system comprising a condenser positioned on an outer surface of the tank;

a boss including a threaded cylindrical portion, a face plate, a lip, and an elliptical junction between the face plate and the lip, the elliptical junction of the boss welded to the vertical sidewall of the tank; and an anode threaded to the threaded cylindrical portion of the boss, the anode extending through the tank into the interior volume of the tank such that the anode is not perpendicular to the vertical sidewall of the tank.

10. The heat pump water heater appliance of claim 9, wherein the vertical sidewall of the tank extends between a top portion and a bottom portion of the tank along the vertical direction, the boss positioned proximate the top portion of the tank.

11. The heat pump water heater appliance of claim 10, wherein the top wall is mounted to the vertical sidewall at the top portion of the tank and the bottom wall is mounted to the vertical sidewall at the bottom portion of the tank.

12. The heat pump water heater appliance of claim 10, wherein the condenser is wound about the vertical of the tank proximate the bottom portion of the tank, the boss positioned above windings of the condenser along the vertical direction.

13. The heat pump water heater appliance of claim 9, further comprising a dip tube mounted to the tank at a top portion of the tank, the dip tube extending downwardly along the vertical direction into the interior volume of the tank, the dip tube configured for directing water into the interior volume of the tank, the dip tube and the anode positioned and oriented such that the dip tube and the anode do not extend parallel to each other.

14. The heat pump water heater appliance of claim 9, wherein the tank defines a longitudinal axis, the anode defining an angle, $\alpha$, with the longitudinal axis, the angle $\alpha$ being greater than fifteen degrees and less than forty-five degrees.

15. The heat pump water heater appliance of claim 14, wherein the angle $\alpha$ is about thirty degrees.

16. The heat pump water heater appliance of claim 9, wherein the face plate is positioned on the vertical sidewall of the tank, the lip extending from the face plate towards the vertical sidewall of the tank.

17. A water heater appliance, comprising:

a tank having a top wall, a bottom wall, and a vertical sidewall extending between the top wall and the bottom wall, the tank defining an interior volume for receiving water for heating; and a boss including a threaded cylindrical portion, a face plate, a lip, and an elliptical junction between the face plate and the lip, a top edge of the face plate positioned at or above a thread of the threaded cylindrical portion, the lip extending from the face plate towards the sidewall of the tank, the elliptical junction of the boss welded to the vertical sidewall of the tank, the threaded portion of the boss extending away from the sidewall of the tank along a direction that is not normal to an outer surface of the sidewall.

* * * * *